US006901930B2

(12) United States Patent
Henley

(10) Patent No.: US 6,901,930 B2
(45) Date of Patent: Jun. 7, 2005

(54) WEARABLE ELECTRO-IONIC PROTECTOR AGAINST INHALED PATHOGENS

(76) Inventor: Julian L. Henley, 38 Munger Rd., Guilford, CT (US) 06437

( * ) Notice: Subject to any disclaimer, the term of this patent is extended or adjusted under 35 U.S.C. 154(b) by 211 days.

(21) Appl. No.: 10/283,104

(22) Filed: Oct. 28, 2002

(65) Prior Publication Data

US 2003/0136408 A1 Jul. 24, 2003

Related U.S. Application Data

(60) Provisional application No. 60/337,508, filed on Nov. 8, 2001.

(51) Int. Cl.[7] ..... A62B 7/10; A62B 23/02

(52) U.S. Cl. ..... 128/205.27; 128/201.22; 128/201.25; 128/205.29

(58) Field of Search ..... 128/201.17, 201.22, 128/201.23, 201.25, 205.27, 205.29, 206.12

(56) References Cited

U.S. PATENT DOCUMENTS 3,421,291 A * 1/1969 Jaschin ..... 96/40
3,702,526 A * 11/1972 Eichmeier ..... 96/16
3,853,512 A * 12/1974 Hayashi ..... 96/59
6,118,645 A * 9/2000 Partridge ..... 361/231
6,157,029 A * 12/2000 Chutjian et al. ..... 250/292

* cited by examiner

*Primary Examiner*—Weilun Lo
*Assistant Examiner*—Michael Mendoza
(74) *Attorney, Agent, or Firm*—Michael G. Petit

(57) ABSTRACT

A device for removing airborne contaminants and inhaled biopathogens, particularly particulate or aerosol contaminants, from respired air that can be either stationary or incorporated into a garment or accessory worn upon the body. In a preferred embodiment, a negative electrode is connected to voltage multiplier and modulation circuit and then to a discharge electrode having an electron emissive surface disposed near the wearer's airway. The positive (counter) electrode is similarly disposed away from the airway such as, for example, near the forehead. Electrons, ejected from the electron emissive surface, transfer a negative charge to airborne particulate contaminants which are accelerated toward, and collected by, the counter electrode.

18 Claims, 6 Drawing Sheets

WEARABLE ELECTRO-IONIC PROTECTOR AGAINST INHALED PATHOGENS

This application claims the benefit of U.S. Provisional Application No. 60/337,508, filed Nov. 8, 2001.

BACKGROUND OF THE INVENTION

1. Field of the Invention

A portable device that can be worn upon the body for removing airborne contaminants such as pathogenic microbes from inspired air, and, more particularly, a wearable personal electrostatic precipitator configured to create a novel bioelectric protective shield.

2. Prior Art

The potential for human exposure to dangerous concentrations of noxious airborne contaminants such as anthrax spores has increased dramatically in recent months due to the introduction of pathogenic organisms into the work environment by deliberate criminal intent. Exposure to airborne contaminants, such as anthrax spores and other air borne biopathogens as well as sarin gas, is highly probable in the future. Civilians are now under attack from hostile forces on an indiscriminate basis. Although the military has access to bioprotective apparatus, very little is available for the civilian population from the defensive or protective standpoint. Gas masks are impractical to be worn on a long-term basis as they interfere with much daily activity. While treatment is available if exposure to organisms such as anthrax is detected early, most prior art efforts to limit human exposure to airborne contaminants have been directed toward removing such toxic particulates or pathogens from the air stream prior to inhalation by a subject, such as, for example, by filtration masks. Mask-like devices are unpleasant to wear and partially obstruct the airway in order to be effective.

In accordance with the art of removing airborne particulate contaminants from an air stream, electrostatic precipitators have enjoyed success. An advantage of electrostatic precipitation-type devices over mask-like filtration devices is that their operation does not require substantial obstruction of the airway through which the air stream passes. The operation of an electrostatic precipitator involves the generation of a strong electrical field through which an air stream bearing a particulate contaminant passes, so that the particles carried by the air stream can be electrically charged by means of emitted electrons. By charging the particles electrically, they can be separated from the gas stream and collected on a collector having an opposite polarity than the (usually negative) charge residing on the particles.

The generation of such electrical fields requires electrical power supplies that can provide a high DC voltage and the associated electron emission technology to impart a charge on the particulate matter and thereby permit its collection. The operation of the particle charging element in many industrial electrostatic precipitators is based upon AC corona theory. A single phase transformer-rectifier is employed to rectify AC power to DC power and provide a high DC potential between a charging electrode, to charge the particles, and a collection surface, usually a plate. The air stream, which is usually stack gases, passes between the charging electrode and the collector plate and is subjected to the maximum current obtainable through the gas without arcing. This approach is believed to impart the maximum charge to the particles and thereby the maximum efficiency in effecting removal of such particles from the airstream. The operating requirements and power consumption of industrial precipitators generally result in a stationary (i.e., non-portable) system that is heavy, cumbersome and cannot be transported, or worn upon the body of a person for purification of the air that the person breathes. There is an urgent need for an electro-ionic protective device that can be worn upon the body. Such a device is described herein.

SUMMARY

It is a primary object of the invention to provide a device that can be comfortably worn upon the body of a person and is operable for removing a contaminant from a stream of air entering the person's airway.

It is a further object of the invention to provide a device meeting the above objective and which does not substantially obstruct the flow of air to the person's respiratory tract.

The present invention discloses a device incorporating electrostatic precipitation employing novel integration of the classic function and operation of ion wind generation and electrostatic precipitation with the wearers body in order to provide a device offering protection, convenience and portability for the individual. Small particles, such as those that are predisposed or maliciously designed to circumvent and penetrate the lung defenses by virtue of their small size, are advantageously accelerated away from the airway by the protective apparatus of the present invention. Smaller particles (<20 microns) are repelled by a preoral emitter disposed within the wearer's airway, as well as by the integrated charge on the wearer's body, and diverted away from the airway and trapped and destroyed on the collector electrode(s) that is disposed away from the airway. Once collected, the particulates, which may include pathogenic organisms, may be treated such as, for example, by chemical sterilization, to render them safe.

In one embodiment of the device, an additional porous, negatively charged adsorbant mask is positionable over the nose and mouth to provide protection against inhalation of an airborne contaminant. The mask itself is charged via a protective bar and an internal, electrically conductive distribution mesh to provide additional circumoral repulsive forces to decrease charge-bearing particles in the airstream passing over the discharge electrode. In another embodiment of the present invention, the mask provides not only particulate protection, but also partial protection against bioterror gases such as nerve gas by incorporation of activated carbon groups within such fibers. Such material is currently commercially available.

In another aspect of the invention, an electron emissive surface operable for ejecting electrons into a space adjacent thereto, the space defining an airway, when a voltage is applied to the electron emissive surface is disclosed. The electron emissive surface comprises an electrically conductive substrate having an outer surface adjacent the space wherein the outer surface is textured. In one embodiment, the textured outer surface comprises a plurality of sharp ridges having valleys therebetween formed in the substrate. The substrate may be doped with atoms such as cesium to reduce the amount of work required to remove an electron from the surface. In another embodiment of the electron emissive surface, a plurality of conductive elements selected from the group consisting of nanotubes, metallic microcrystals and semiconductor filaments are affixed to the outer surface of the substrate to provide a textured outer surface. The conductive elements have a fixed end affixed to the outer surface of the substrate and a free end projecting into the space.

The features of the invention believed to be novel are set forth with particularity in the appended claims. However the invention itself, both as to organization and method of operation, together with further objects and advantages thereof may be best understood by reference to the following description taken in conjunction with the accompanying drawings in which:

DESCRIPTION OF THE PREFERRED EMBODIMENTS

As used herein, the term "discharge electrode", when used in the context of a personal electrostatic precipitator having a bipolar power source, means an electrode connected to a first pole of the bipolar power source that is operable for transferring an electrical charge to an airborne contaminant. The term "collector electrode" means an electrode in electrical connection with a second pole of the bipolar power source wherein the second pole has an opposite polarity than the first pole. The term "ion wind generator", as used herein, means a device, or a portion of a device, operable for ionizing molecules present in an air stream and accelerating the ionized molecules thus formed in a predetermined direction.

Figure 1:
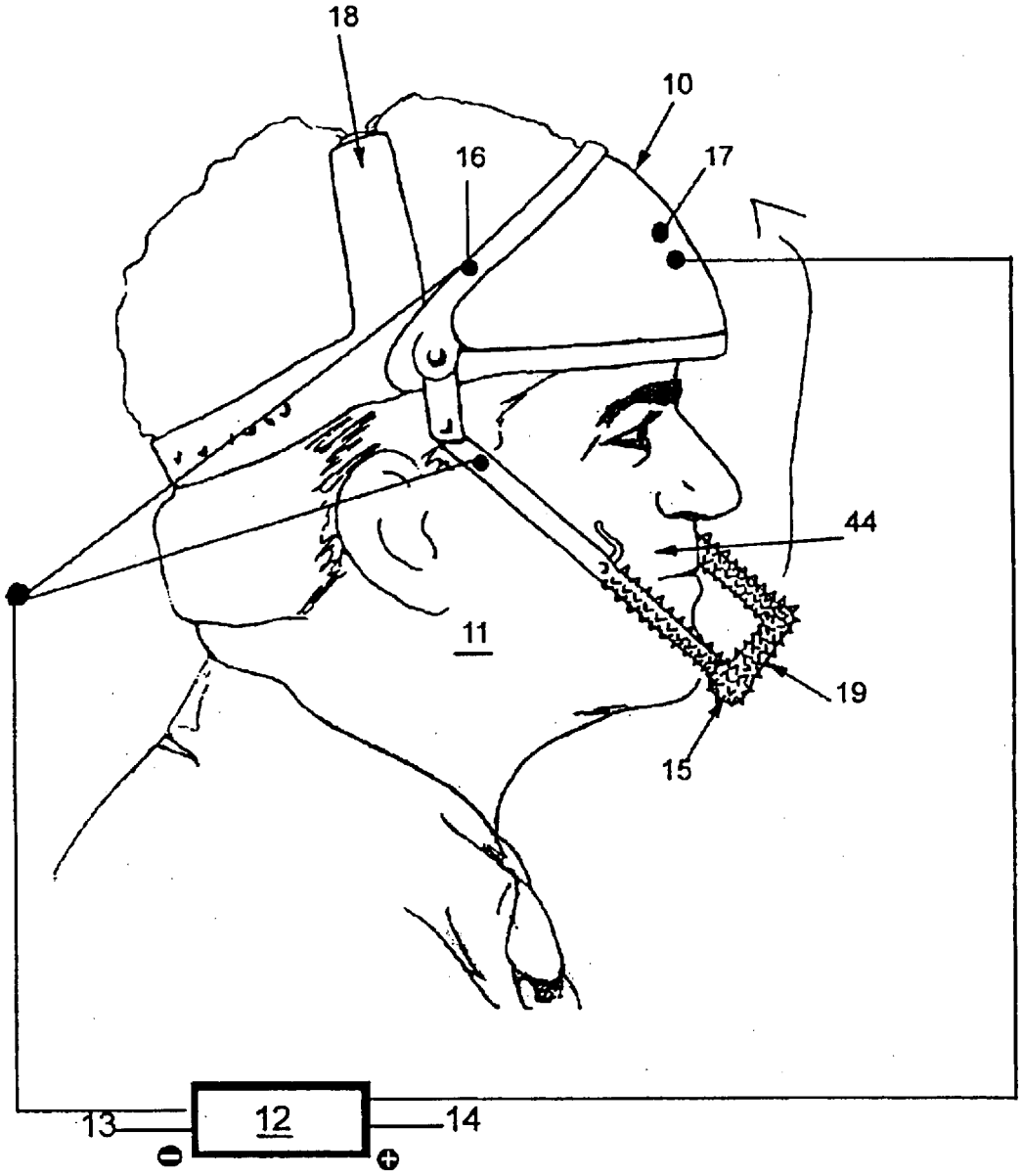
FIG. 1 is a side view of a person wearing a personal electrostatic precipitator device including an activated ion shield generator in accordance with a preferred embodiment of the present invention wherein the risk of exposure to an airborne contaminant is minimal. The device enables the wearer to conveniently and comfortably continue with daily activity such as talking, telephone usage, eating and drinking while wearing such a device.

With reference to FIG. 1, in which a personal electroionic inhalation protective device 10 is shown mounted upon the head of a person 11, the device 10 comprises a bipolar power source 12 having a first pole 13 and a second pole 14, a discharge electrode 15, a personal electrode 16 in electrical connection to the first pole 13, and a collector electrode 17 in electrical connection to the second pole 14 of the bipolar power source 12. The positioning and support of the three electrodes 15, 16 and 17 with respect to the person 11 is provided by headwear 18. The discharge electrode 15 has an electron emissive surface 19 thereon as will be discussed in greater detail below.

Figure 2:
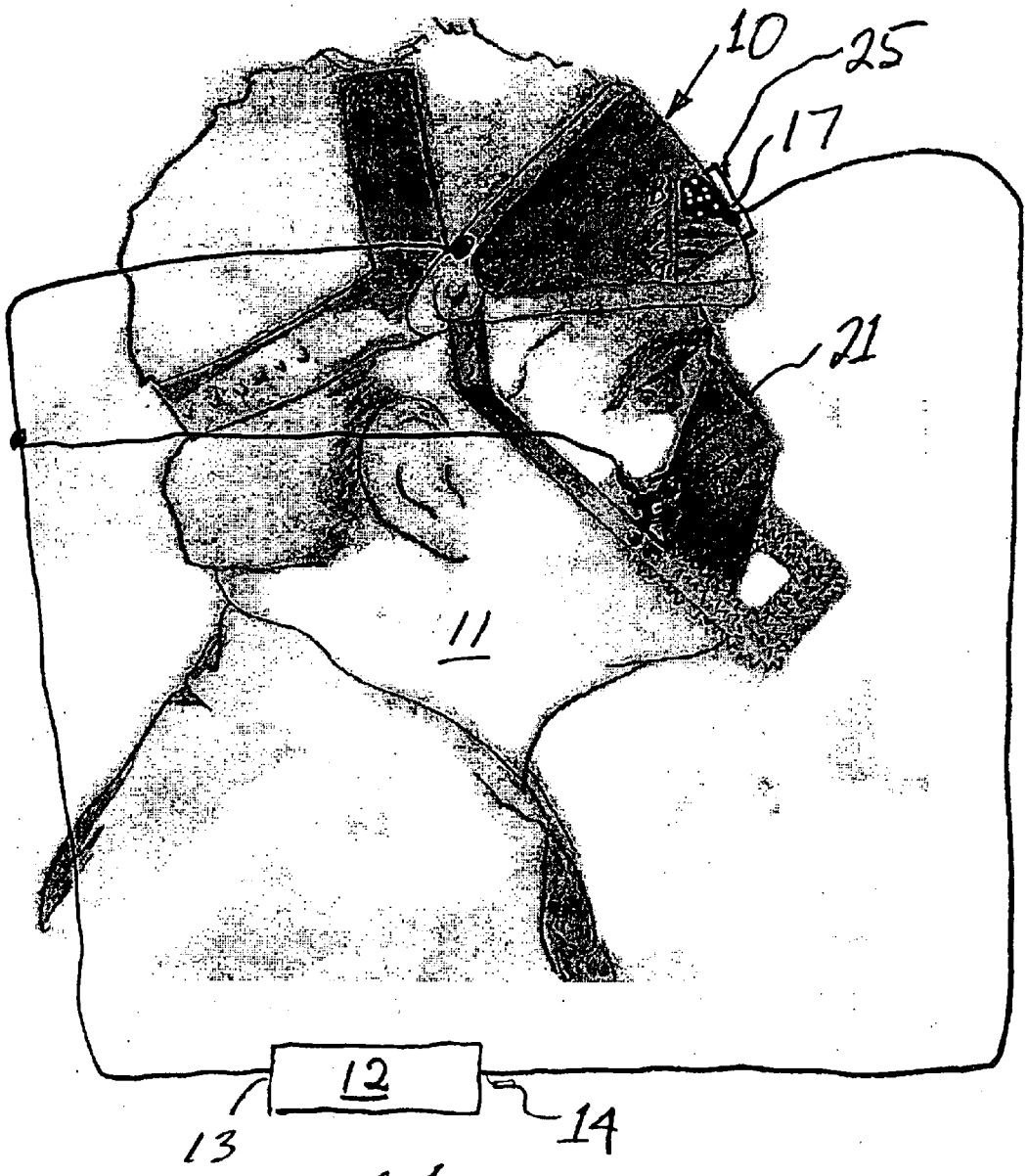
FIG. 2 is a side view of a person wearing a personal electrostatic precipitator device in accordance with a preferred embodiment of the present invention wherein the risk of exposure to an airborne contaminant is high.
Figure 3:
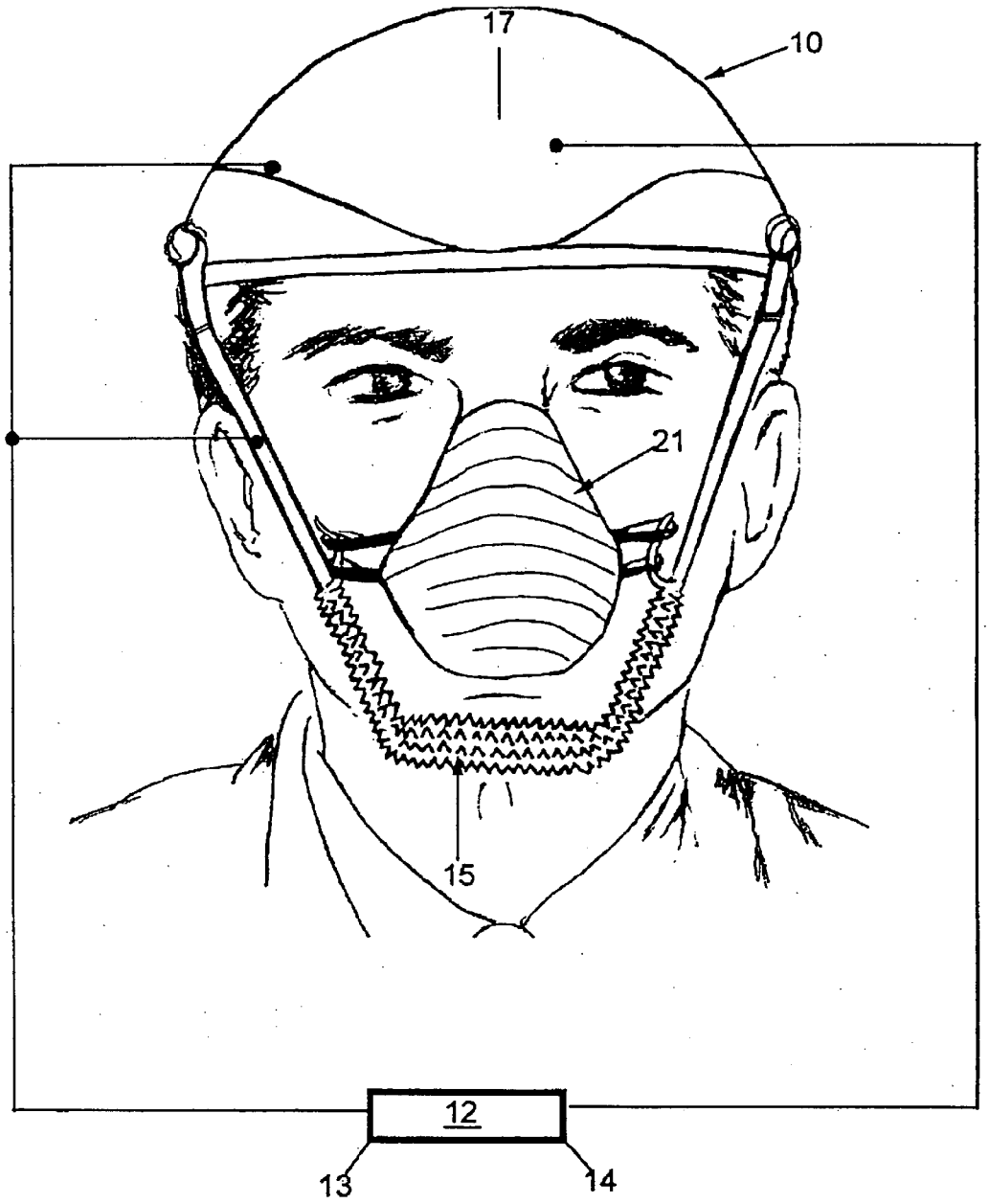
FIG. 3 is a front view of a person wearing a personal electrostatic precipitator device in accordance with a preferred embodiment of the present invention wherein the risk of exposure to an airborne contaminant is high.

FIG. 2 illustrates the device 10 with a mask 21 deployed in the event of high exposure of the person 11 to airborne particulate contaminants. The mask 21 is porous and is negatively charged to repel negatively charged particulate contaminants in the air. Such negative charge is imparted unto the airborne particles by the primary discharge electrode 15 disposed anterior to the chin. FIG. 3 shows the device 10 of FIG. 2, in front view.

As mentioned in the discussion of the prior art, conventional discharge electrodes operate at a relatively high voltage and rely on corona discharge to confer a charge on an airborne particulate. There are several technologies that enhance the efficiency and efficacy of electron release by field emission that may be employed to inject electrons into the space surrounding the discharge electrode 15 in order to charge target particles to be precipitated and deflected away from the airway. A large electric field surrounding a sharp edge or point facilitates the injection, release and escape of electrons from a conducting surface. Less energy is required to remove an electron from a conductive surface comprised of sharp edges, projecting filaments or points, than from a flat conductive surface. A thin, metallized Mylar film (i.e., a polymeric film having a metallic coating on one side thereof) is readily available commercially, and the sheet can be shredded to form conductive filaments that can be affixed to a conductive surface. Metal shavings, available as byproducts from a machining operation, can also be adhered to a conductive surface to provide a plurality of conductive filaments projecting therefrom. Conductive micro and nanotubes may also be employed to form an electron emissive surface. Once affixed to the surface such that the filaments project outwardly into an air stream, the sharp edges of such thinly cut foil filaments, metal shavings or nanotubes will facilitate the injection of electrons into the ambient air stream with subsequent attachment to particulate contaminants such as microbial spores.

Figure 4:
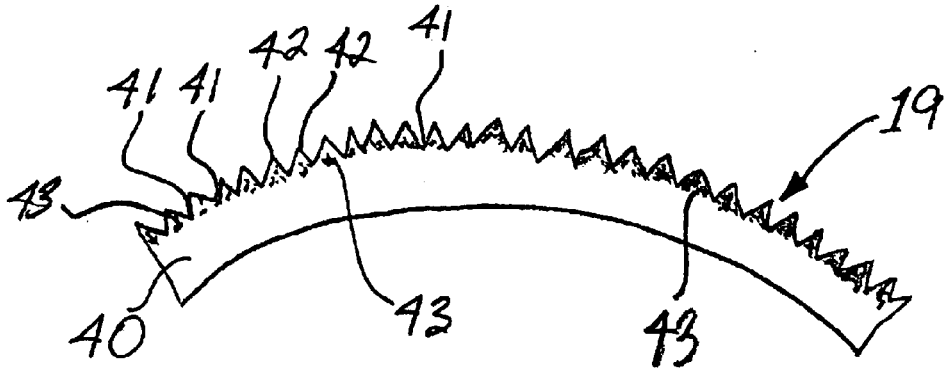
FIG. 4 is a cross-sectional view of a discharge electrode having an electron emissive surface in accordance with a preferred embodiment of the present invention.

In one embodiment of a discharge electrode 15, shown in transverse cross-sectional view in FIG. 4, the electron emissive surface 19 is constructed using existing semiconductor manufacturing technology. The electron emissive surface 19 comprises a substrate 40 having a plurality of microscopic etched grooves 41 having sharp points or sharp ridges 42 therebetween. In addition, the surface of these points or edges 42 can be doped with a conductive material 43 such as Cesium having a low electron work function (i.e., the average energy that is required to remove an electron from a conductive surface), employing standard doping techniques such as ion implantation and/or a gas diffusion process. The presence of Cesium 43 or a similar dopant at or near the sharp point(s) 42 lowers the energy required to eject an electron from the electron emissive surface 19 of the discharge electrode 15. Other materials that may be used to lower the electron work function of the surface are barium, cerium, potassium and lithium. The incorporation of an element such as cesium, having a relatively low electron work function of 2.14 eV, will substantially and dramatically reduce the magnitude of the electric field necessary for electron injection into the surrounding air. With a given geometry or sharp point, this means a lower bias potential is required as well as a reduced energy expenditure per electron ejected.

Electrons, after leaving the sharp point 42 on the (negative) electron emissive surface 19 on the discharge electrode 15, eventually migrate towards the (positive) collector electrode 17 (FIGS. 1–3) and attach, en-route, to spores and other particulate contaminants in the air stream. The electrostatic, charged spores are repelled from the perioral/nasal area due to the negative charge imparted on the skin and hair of the person 11 (FIG. 1); the negative charge being established through the personal electrode 16 which is in electrical connection with the skin on the person's forehead. The repelled charged particulates are subsequently diverted to impact a germicidal, collecting surface 25 (FIG. 2) located directly in front of the collector electrode 17, which collecting surface 25 is disposed at a safe distance from the face. Such collecting electrode 25 can be covered by a removable hydrogel membrane that is impregnated with chlorox, peroxide or other sporocidal/bacteriocidal agent. The hydrogel coating on the collector provides spore adherence as well as sporocidal functions so that the disposal of such a membrane is not an environmental issue. Electrostatic repulsion and attraction, combined with entrapment and biocidal components, is an efficient means for removing particulates such as spores from an air stream and purifying the inspired air from bioinfective agents configured as small particles that have the advantage of penetrating deep into the lung and bypassing normal coughing, mucosal adhesion, respiratory filtration and clearing defensive measures.

The use of a dopant such as cesium in the electron emissive surface 19 can substantially reduce the power and, more importantly, the voltage requirements of a personal electrostatic precipitator device 10. For example, to inject electrons into surrounding air with standard electrically conductive materials, and employing sharp edge technology, the requirements may be in the range of 500 volts to 1200 volts. The presence of cesium in the electron emissive surface 19 at or near the sharp point-air interface may reduce the necessary voltage to 100 volts. The dopant material can also be deposited and bonded to the electron emissive surface by means of plasma activation and bonding of the dopant material directly to the electron emissive surface, either as a single or two atomic thickness layer, in accordance with the method developed by k.w. Chang. The dopant material, whether deposited by a plasma discharge, chemical vapor deposition, ion implantation or molecular diffusion technology, should be selected so that it lowers the electron work function of the electron emissive surface 19. A simple bipolar power source such as a 3 volt battery, boosted to a 50 V–3000 V output voltage by an upconverter, may be employed to operate the device 10.

Figure 5:
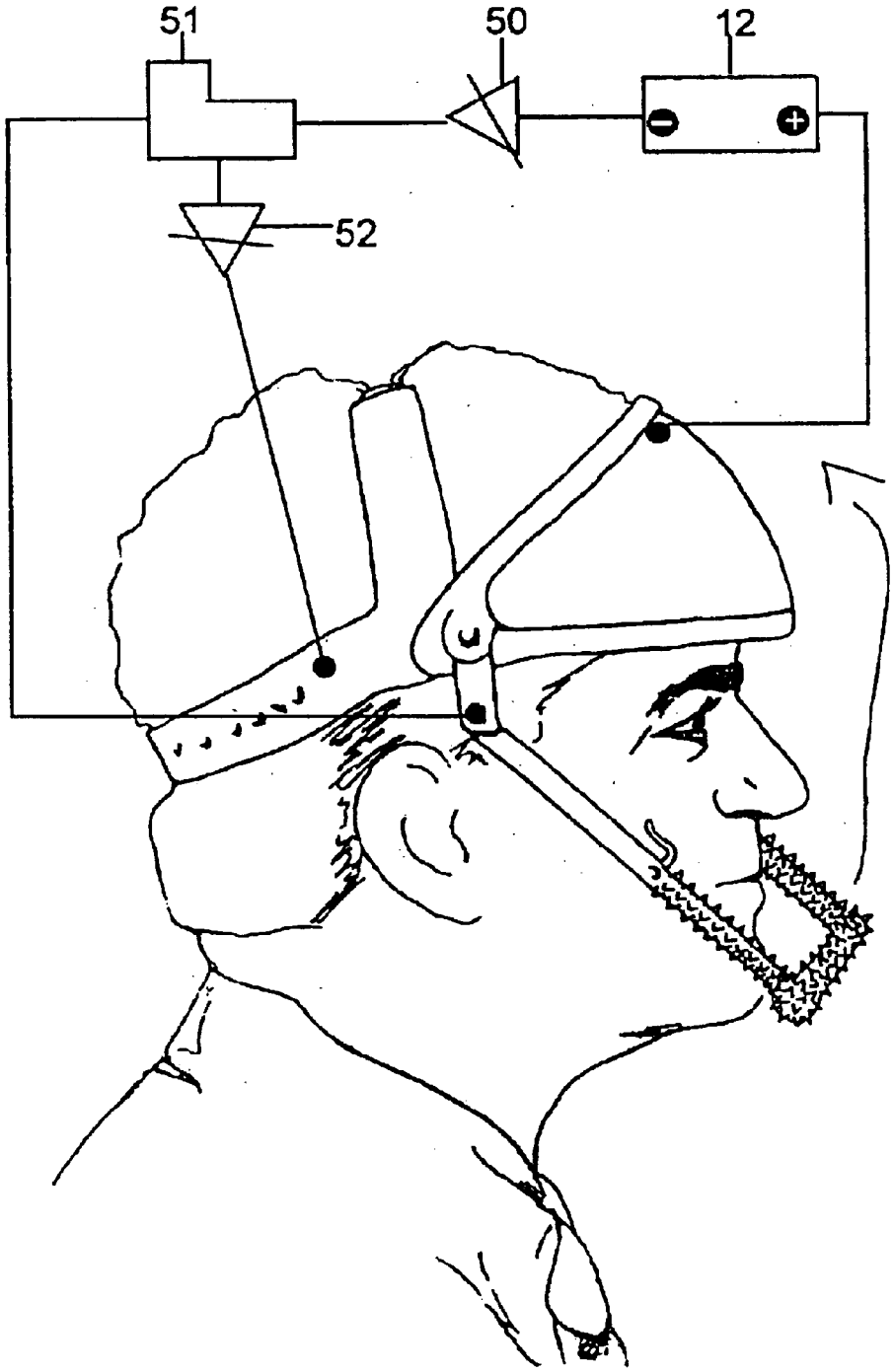
FIG. 5 is a side view of a person wearing a personal electrostatic precipitator and the incorporated ion shield generator device in accordance with the preferred embodiment of the present invention illustrated in FIG. 1 wherein the bipolar power source for the device comprises current limiting circuitry to limit the impact of accidental discharge when the hand accidentally makes contact with the collector plate. During testing of the working prototype device, such event felt no different than touching a doorknob after walking upon a carpet on a low humidity day.

FIG. 5 is a side view of a person wearing a personal electrostatic precipitator device in accordance with the preferred embodiment of the present invention illustrated in FIG. 1, wherein the bipolar power source 12 for the device includes current limiting circuitry to prevent accidental discharge of the person's body as, for example, by touching the collector plate. If, for example, the bipolar power source 12 is a battery, it may be desirable, or even necessary, to limit the current output of the battery with a current limiter 50 and boost the voltage output of the battery 12 with a voltage multiplier 51. A second current limiter 52 disposed between the personal electrode 16 and the output of the second current limiter 52 serves to prevent current surge in the event that the charge on the person's body is inadvertently changed such as by accidental grounding. It may also be desirable to include modulation means operable for modulating the output voltage of the voltage multiplier 51.

Figure 6:
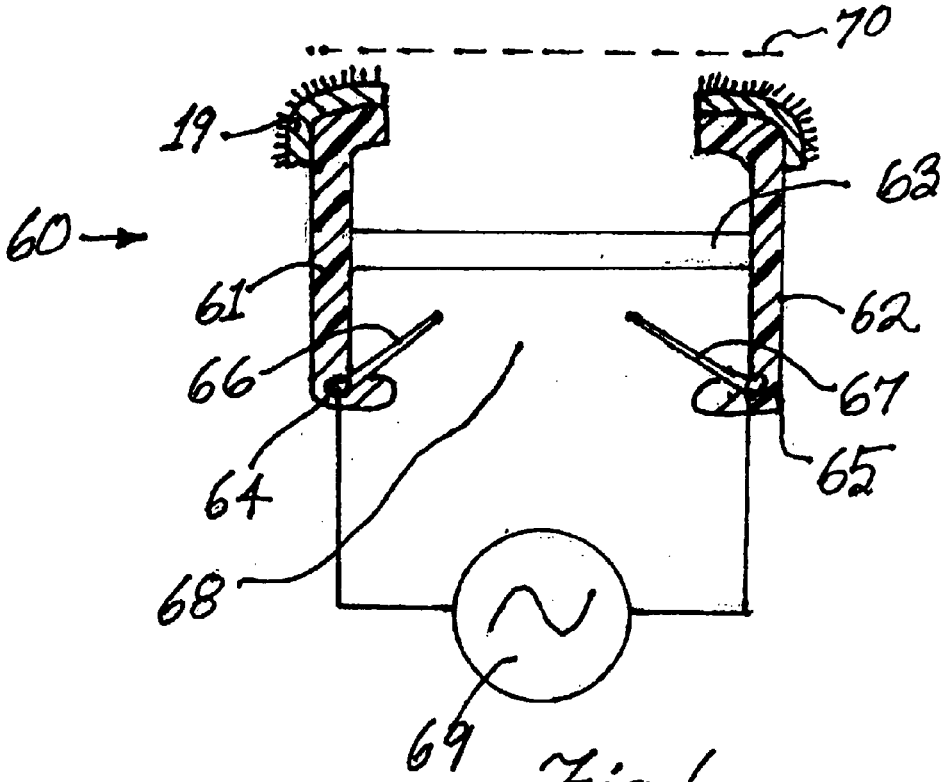
FIG. 6 is a transverse cross-sectional view of a discharge electrode having an electron emissive surface comprising electrically conductive microfibrils or microtubules, and an activated ion shield generator in accordance with a second preferred embodiment of the present invention.

Ion wind generation is a technology that has not previously been employed in conjunction with electrostatic precipitation to purify air. The term "ion wind generator", as used herein, means a device, or a portion of a device, operable for ionizing molecules present in an air stream and accelerating the ionized molecules thus formed in a predetermined direction. FIG. 6 is a transverse cross-sectional view of a discharge electrode having, in combination, an ion wind generator and an electron emissive surface comprising electrically conductive microfibrils, nanotubes, sharp projections, semiconductors with emissive properties, or microtubules in accordance with a second preferred embodiment of the present invention. The discharge electrode 60 includes two parallel electrically nonconductive supports 61 and 62 connected to one another by one or more nonconductive bracing bars or struts 63. The supports 61 and 62 have electrically conductive wires 64 and 65 either embedded therein or affixed thereto, the wires 64 and 65 being substantially coextensive with the length of the supports 61 and 62. The wires 64 and 65 have a plurality of conductive whiskers 66 and 67 projecting inwardly therefrom and terminating within the airflow pathway 68. The length of such projecting whiskers 66 and 67 is optimally an integral multiple of quarter wavelengths the oscillating high voltage wavelength. Such a length/frequency relationship imparts efficient energy transfer to the formation of plasma induction in the vicinity of the tips of such projections.

The wires 64 and 65 are in electrical communication with a high voltage (~600–2000 volts) AC power supply 69 that operates preferably at about 50–700 kilohertz with a peak to peak voltage swing of about 1200 volts. The voltage across opposing whiskers 66 and 67 ionizes the air passing therebetween, the ionized air being accelerated toward and through porous grid 70 which is metallic and negatively charged. The larger ionized molecules will be positively charged (as the electrons have been accelerated out of outer molecular orbitals) and these larger molecules will be accelerated to the negatively charged grid. As such positively charged species pass through the grid with moderate flow velocity, the surface-mounted electron emitters neutralize the positively charged molecules and, in addition, inject an excess of free electrons that will efficiently be carried in front of the respiratory entrance and adhere to any airborne particles. This imparts a negative charge to such particles that are then deposited on a positive (attractive) collector electrode disposed away from the respiratory pathway. Such a configuration is unique inasmuch as it creates an activated ion flow shield in front of the face (that has known biocidal activity) with electrostatic diversion and deposition of particulate contaminants upon a collector electrode which may be further treated to provide additional biocidal chemical activity.

Figure 7:
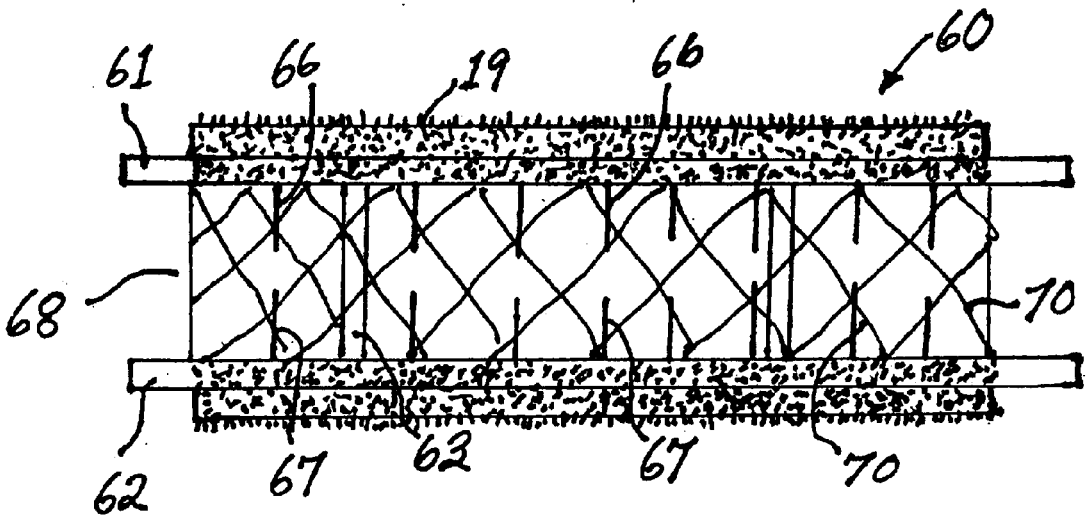
FIG. 7 is a longitudinal (side) view of the second preferred embodiment of the discharge electrode shown in FIG. 6 having an electron emissive surface comprising electrically conductive microfibrils, nanotubes or microtubules and an activated ion shield (ion-wind) generating means.

The fundamental principles of ion activation, flow bioshielding, electrostatic diversion, perioral repulsion, and biocidal chemical deposition collection work together in an electro ionic shield generator device 10 having a discharge electrode 60, as shown in FIGS. 6 and 7, to provide a portable device and non-obstructing protection against inhalation of small pathogens that can otherwise circumvent normal pulmonary defense mechanisms. This embodiment uses electrostatic, radio frequency ionization and chemical biocidal collection to offer individual protection as described in this embodiment.

FIG. 7 is a top view of the second preferred embodiment of the discharge electrode 60 shown in FIG. 6. The electron emissive surface 19 has a plurality of electrically conductive metallic particles, microfibrils, microtubules, emissive semiconductor, or especially nanotubes extending outwardly therefrom. Both the ions comprising the ion wind and electrons ejected from the electron emissive surface 19 collide with particulate matter such as anthrax spores in the airstream. As with the first embodiment of the discharge electrode, negatively charged particles will be deflected away from the perioral area to impact a collector electrode that is preferable coated with a hydrogel impregnated with a chemical biocidal agent (chlorox, peroxide, hexachlorophine etc) to contain the particulate contaminants.

While particular embodiments of the present invention have been illustrated and described, it would be obvious to those skilled in the art that various other changes and modifications can be made without departing from the spirit and scope of the invention. For example, while the collector electrode is illustrated as being integral with the headwear in the above-described embodiments, the collector electrode may be disposed elsewhere. It is an important feature of the invention that the electron emissive surface and ion wind generator comprising the device be disposed in the vicinity of the mouth and nose. The collector electrode may be a conductive countertop or overhead structure that forms a part of the wearer's work environment. In addition, the mask 21 may further include an agent that reduces the toxic effects of a non-particulate airborne contaminant. It is therefore intended to cover in the appended claims all such changes and modifications that are within the scope of this invention.

What I claim is:

1. A device for removing particulate contaminants from an air stream entering a person's respiratory tract comprising:

(a) a bipolar power source having a first pole and a second pole;

(b) a body mountable support;

(c) a discharge electrode mounted on said support and in electrical connection with said first pole;

(d) a collector electrode mounted on said support and in electrical connection with said second pole; and (e) a personal electrode mounted on said body mountable support, said personal electrode operable for providing electrical connection between said first pole and the person's skin when the support is worn upon the persons body.

2. The device of claim 1 wherein said support is adapted to be worn upon the head or neck of the person.

3. The device of claim 2 wherein said discharge electrode is disposed adjacent the person's airway when said support is worn upon the person's head, lower neck or shoulder.

4. The device of claim 3 wherein said discharge electrode is adjustably mounted on said support.

5. The device of claim 1 further comprising a germicidal layer disposed between said collector electrode and said discharge electrode.

6. The device of claim 2 further comprising a germicidal layer disposed between said collector electrode and said discharge electrode.

7. The device of claim 3 further comprising a germicidal layer disposed between said collector electrode and said discharge electrode.

8. A device in accordance with claim 1 further comprising a porous mask movably affixed to said support.

9. The device for removing particulate contaminants from an air stream entering a person's respiratory tract in accordance with claim 1 wherein said discharge electrode comprises:

(a) an activated ion shield generator; and (b) an electron emissive surface comprising electrically conductive microfibrils, microtubes, nanotubes, sharp projections or semiconductors operable for emitting electrons when a voltage is applied thereto.

10. The device of claim 9 wherein said ion wind generator comprises two parallel, electrically nonconductive supports having a length and a space therebetween defining an airway, said supports being connected to one another by one or more nonconductive bracing bars wherein said supports have electrically conductive wires affixed thereto, said wires being substantially coextensive with said length, and wherein said wires have a plurality of conductive whiskers projecting into said airway.

11. The device of claim 10 wherein said wires are in electrical communication with a high voltage AC power supply that produces an oscillating voltage output having a wavelength and operates preferably at about 50–700 kilohertz.

12. The device of claim 11 wherein said whiskers have a whisker length that is substantially an integral multiple of quarter wavelengths.

13. A device for removing particulate contaminants from an air stream entering a person's respiratory tract comprising:

(a) a bipolar power source having a first pole and a second pole;

(b) a body mountable support;

(c) a discharge electrode mounted on said support and in electrical connection with said first pole;

(d) a collector electrode in electrical connection with said second pole; and (e) a personal electrode mounted on said body mountable support, said personal electrode operable for providing electrical connection between said first pole and the person's skin when the support is worn upon the persons body.

14. The device of claim 13 wherein said support is adapted to be worn upon the head or neck of the person.

15. The device of claim 14 wherein, said discharge electrode is disposed adjacent the person's airway when said support is worn upon the person's head, neck and upper chest.

16. The device of claim 15 wherein said discharge electrode is adjustably mounted on said support.

17. The device of claim 13 further comprising a germicidal layer disposed between said collector electrode and said discharge electrode.

18. A device for removing particulate contaminants from an air stream entering a person's respiratory tract comprising:

(a) a bipolar power source having a first pole and a second pole;

(b) a discharge electrode in electrical connection with said first pole;

(c) a collector electrode in electrical connection with said second pole, wherein said discharge electrode comprises a sharply contoured electron emissive surface.

* * * * *